United States Patent [19]

Green et al.

[11] 4,111,118

[45] Sep. 5, 1978

[54] MULTI-PURPOSE SCREEN PRINTING MACHINE

[75] Inventors: Melvin E. Green; Charles H. Derrickson, both of Chicago, Ill.; Louis A. Lala, Dayton, Ohio

[73] Assignee: American Screen Printing Equipment Co., Chicago, Ill.

[21] Appl. No.: 720,763

[22] Filed: Sep. 7, 1976

[51] Int. Cl.[2] ..... B41F 15/26; B41F 15/30

[52] U.S. Cl. ..... 101/123; 101/35; 101/38 R

[58] Field of Search ..... 101/123, 124, 38 R, 101/35, 41, 126

[56] References Cited

U.S. PATENT DOCUMENTS

| | | | |
|---|---|---|---|
| 2,783,709 | 3/1957 | Thomas | 101/123 |
| 3,090,300 | 5/1963 | Dubuit | 101/123 |
| 3,166,011 | 1/1965 | Landesman | 101/123 |
| 3,490,363 | 1/1970 | Derrickson | 101/38 R |
| 3,659,523 | 5/1972 | Olsen | 101/38 R |
| 3,762,318 | 10/1973 | Dubuit | 101/124 |
| 3,838,639 | 10/1974 | Harwell, Jr. et al. | 101/123 |
| 3,859,917 | 1/1975 | Bubley et al. | 101/123 |
| 3,874,289 | 4/1975 | Valentin | 101/123 |
| 3,902,412 | 9/1975 | Pabodie | 101/288 |

*Primary Examiner*—William Pieprz

*Attorney, Agent, or Firm*—Robert E. Wagner; Gerald T. Shekleton; Robert E. Browne

[57] ABSTRACT

An improved low cost screen printing apparatus for printing on both flat and curvilinear objects. Two vertically aligned shafts support the printing head and, by following the pivotal motion of an arm, raise and lower the printing head relative to the object being printed with a straight vertical displacement, resulting from the controlled movement of the upper shaft cooperating with arcuate channels formed in the end supports. The squeegee assembly operates in a timed relationship with the raising and lowering of the screen head to alternately lower the squeegee and raise the flood bar for forcing ink through the screen in the print cycle and raise the squeegee and lower the flood bar to flood the screen on the return cycle. When the screen is in the raised position, the squeegee assembly and screen frame are selectively connectable to a reciprocating carriage, for printing either curvilinear or flat objects.

12 Claims, 10 Drawing Figures

MULTI-PURPOSE SCREEN PRINTING MACHINE

BACKGROUND OF THE INVENTION

This invention relates to printing equipment in general and, more specifically, is addressed to a new and improved screen printing machine which is readily adapted to print on objects of various shapes.

Stencil screen printing in the past was known as silk screen printing because of the use of silk as the material for the stencil screen. Even though modern fabrics made the use of silk obsolete, stencil screen printing is still sometimes referred to as silk screen printing. The technology is relatively simple: A printing fluid, such as ink, is transferred to the surface to be printed by means of a squeegee, which forces the ink through a stencil screen having certain areas open, with other areas blocked off, thereby forming the desired design. A wide variety of objects may be printed with the screen printing technique, such as clock dials; ash trays; irregular objects such as plates, cups and coffee pots; and flatwork such as glass and glass thermometers, to mention a few. The applications of screen printing are widespread and continue to increase each year.

Where several different colors are printed, registration of the object to be printed and repeatability of the print is essential for a high-quality multi-color product. In printing flatwork, the screen is held stationary and the squeegee moves across the screen to force the ink through the screen onto the object to define the chosen pattern. Obviously, in this application it is desirable to have the object to be printed in rigid attachment and bring the screen and squeegee to the work. In the printing of irregular objects, such as conical, curvilinear, or cylindrical objects, the squeegee remains stationary and continually biased on the screen, which screen moves simultaneously and at the same linear rate as the circumferential speed of the object to be printed. As before, the squeegee forces the ink through selected areas on the screen to form on the irregular object. One example of such type of printing is a cylindrical pail or drum bearing a message or design. Also, many types of household cylinders formed of plastic by the blow-molding process carry messages and designs. All of the above flat and irregular objects may be imprinted on a machine of the type described herein.

THE PRIOR ART

One known type of screen printing machine is that described in U.S. Pat. No. 3,090,300, issued May 21, 1963, which machine has been very popular and successful commercially since its introduction. Notwithstanding the commercial success of the machine shown and described in the above patent, many disadvantages exist, chiefly in the area of a relatively high cost of manufacture, which cost is directly related to its design. Moreover, the design characteristics of the prior art are such that the end supports and parts for such a printing machine are required to be made of extremely heavy weight materials, adding to its cost and undesirability insofar as shipping, set-up, movement and handling.

GENERAL DESCRIPTION OF THE INVENTION

The present invention relates to an improved screen printing machine which permits the object to be printed to be held rigid and the screen and squeegee raised and lowered onto the work. The screen printing machine includes a pair of spaced end supports adapted for mounting on a suitable base or the like. Journaled in the end supports is a first shaft extending between the supports and mounted for rotational movement. A guide bar is joined to the ends and is positioned above the lower rear shaft. Keyed to the first shaft is a pair of arms, which, at their forward ends, support a second shaft. The second shaft is joined by a pair of links near its ends to a third shaft, which is positioned in vertical alignment above the second shaft. The ends of the third shaft extend through the links and are provided with guide rollers, cooperating with arcuate slots formed in the end supports, which permit the upper front shafts to move in a controlled path when the arms are pivoted about the first shaft.

Carried on the second and third shafts are screen support arms which join the first and second shafts and have a means at their lower end for attachment to the screen frame, holder or the like. Also carried on the second and third shafts for reciprocating movement is a squeegee assembly, which supports the squeegee for movement over the stencil screen. Each of the squeegee assembly and screen supports is provided with means permitting it to be selectively attached to a drive assembly having a carriage mounted for reciprocation on the first or lower rear shaft. The drive carriage reciprocates along the first shaft and has a pair of guide rollers which engage a guide bar extending between the end supports. The drive carriage may be provided with a rack, which cooperates with a pinion for rotating cylindrical, irregular or curvilinear work, thereby enabling the work to be moved at the same rate as the screen during the printing process.

The squeegee assembly includes a squeegee and flood bar, which are alternately raised and lowered in cooperation with the raising and lowering of the screen assembly. This action occurs through a novel pivoting action imparted to a rocker arm having its opposite ends connected to the squeegee and flood bar through vertical connecting shafts which, in turn, support the squeegee and flood bar, respectively, at the lower end. The relative height of each shaft is readily adjusted at the front of the squeegee assembly to control the pressure of the squeegee and flood bar on the screen. The rocker arm is driven by a shaft having an actuating arm at the opposite end. The actuating arm is biased against the top of the guide bar so that the lifting of the screen pivots the rocker arm for the flood condition during the elevating cycle of the screen. The entire squeegee assembly is adapted to be pivoted upwardly to a convenient position whenever screen or squeegee maintenance becomes necessary.

The new and improved screen printing machine provides considerable advantages in the manufacture and operation of the machine because of the reduced number of parts and simplicity of design. This, of course, contributes to the reduced costs of manufacture and maintenance, and enlarges the number of applications of the machine.

It is, therefore, an object of this invention to provide a new and improved screen printing machine which is convertible from printing on flat objects to printing on irregular or curvilinear objects.

It is a further object of this invention to provide a new and improved screen printing machine of simplified design which is adaptable to a wide variety of uses.

It is a still further object of this invention to provide a screen printing machine in which the screen will be maintained in a substantially horizontal condition during both printing and flood cycles, thereby promoting greater uniformity and ink distribution during the printing operation.

It is another object of this invention to provide a new and improved screen printing machine which permits use of a variety of simplified drive arrangements and is readily adaptable to printing on a wide variety of shapes.

It is a still further object of this invention to provide a machine which will be easily tooled and operate in a smooth and consistent manner with excellent registration capability.

It is yet another object of this invention to allow easy maintenance and replacement of the screen and squeegee blades.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein:

Referring now to FIG. 1, the improved screen printing machine is indicated by reference numeral 10 and includes a base of any suitable design, such as that shown at 110, on which is placed the upper cabinet 111. The upper cabinet 111 houses the screen printing head, which is shown in elevation and top plan in FIGS. 2 and 3, with the cabinet omitted.

A tooling post 112 extends from the cabinet 110 and supports a jig or fixture (not shown) on which the material which is to be printed may be supported. As shown in FIGS. 2 and 3, the printing head includes a pair of end supports 13 and 15, formed of any suitable material such as cast iron or the like. Each of the end supports rest on any suitable base, which may be the top 14 of the lower cabinet 111. The end supports 13 and 15 are secured to the top 14 by any desired form of fastening, such as bolts or the like.

Figure 3:
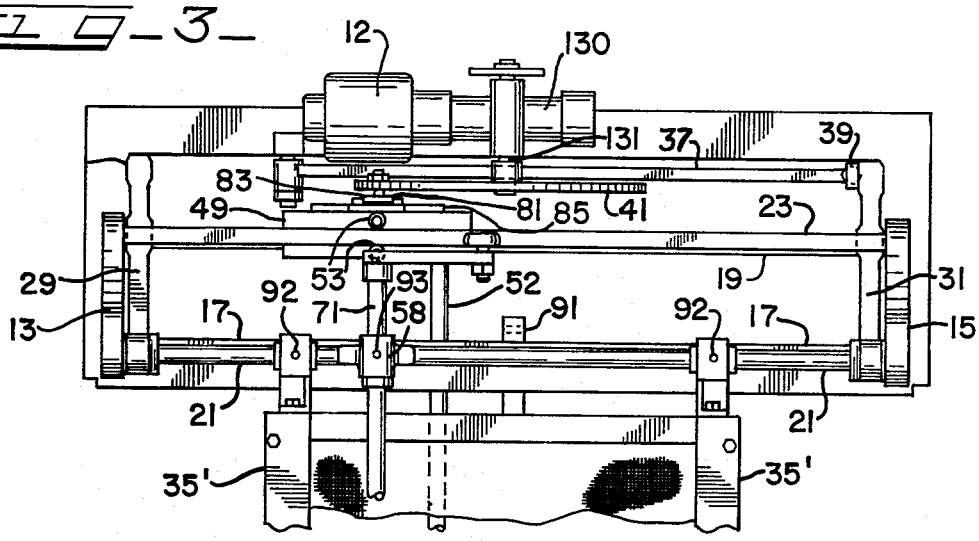
FIG. 3 is a top view of the improved screen printing machine of FIG. 2.

The printing head includes a first or rear horizontal shaft 19, which is best seen in FIG. 3, which shaft 19 is mounted for pivoting or oscillating movement in bearings carried in the end supports 13 and 15. Connected to the shaft at either end are pivoting arms 29 and 31, which are attached to the shaft by a bolt 113 (FIGS. 4 and 5) and oscillate with it as the shaft 19 turns.

The arms 29 and 31 support at their front or outer ends a second horizontal shaft 17 which, in the lowered condition, is in horizontal alignment with the rear shaft. A pair of vertical links 26 and 28 are supported on the front shaft 17 and have bifurcated ends extending on either side of the lower arms 29 and 31. At the upper end of the links 26 and 28 is supported a third shaft 21, which extends slightly beyond the links and receives guide rollers 45 (FIGS. 4 and 5), which cooperate with an arcuate channel 47 formed in the end support 13. An identical guide roller 45 (not shown) rides on the opposite end of shaft 21 and also travels in an arcuate channel 47 formed in end support 15 (not shown). While the guide channel 47 is illustrated as being arcuate, it may take any other desired shape.

Figure 2:
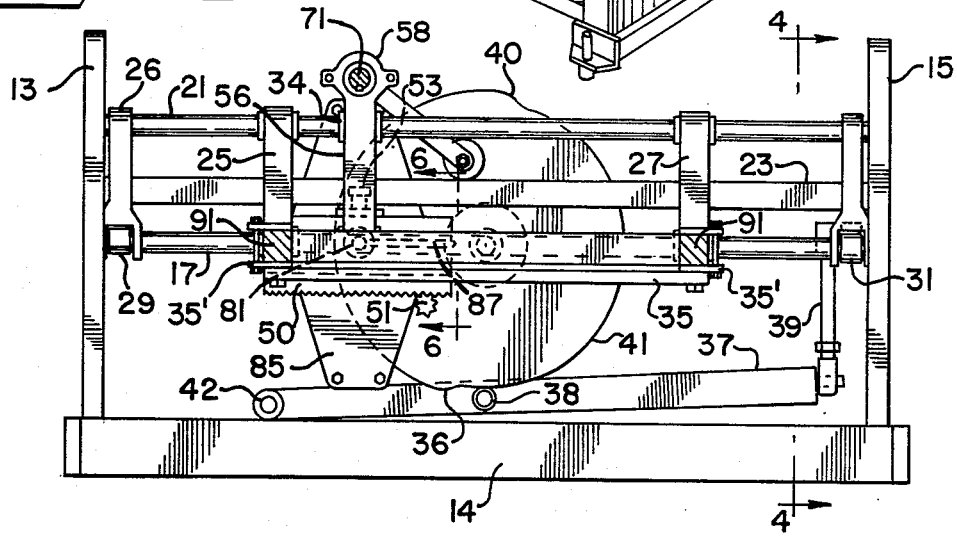
FIG. 2 is a front elevational view of the improved screen printing machine of FIG. 1 with the cabinet omitted.
Figure 4:
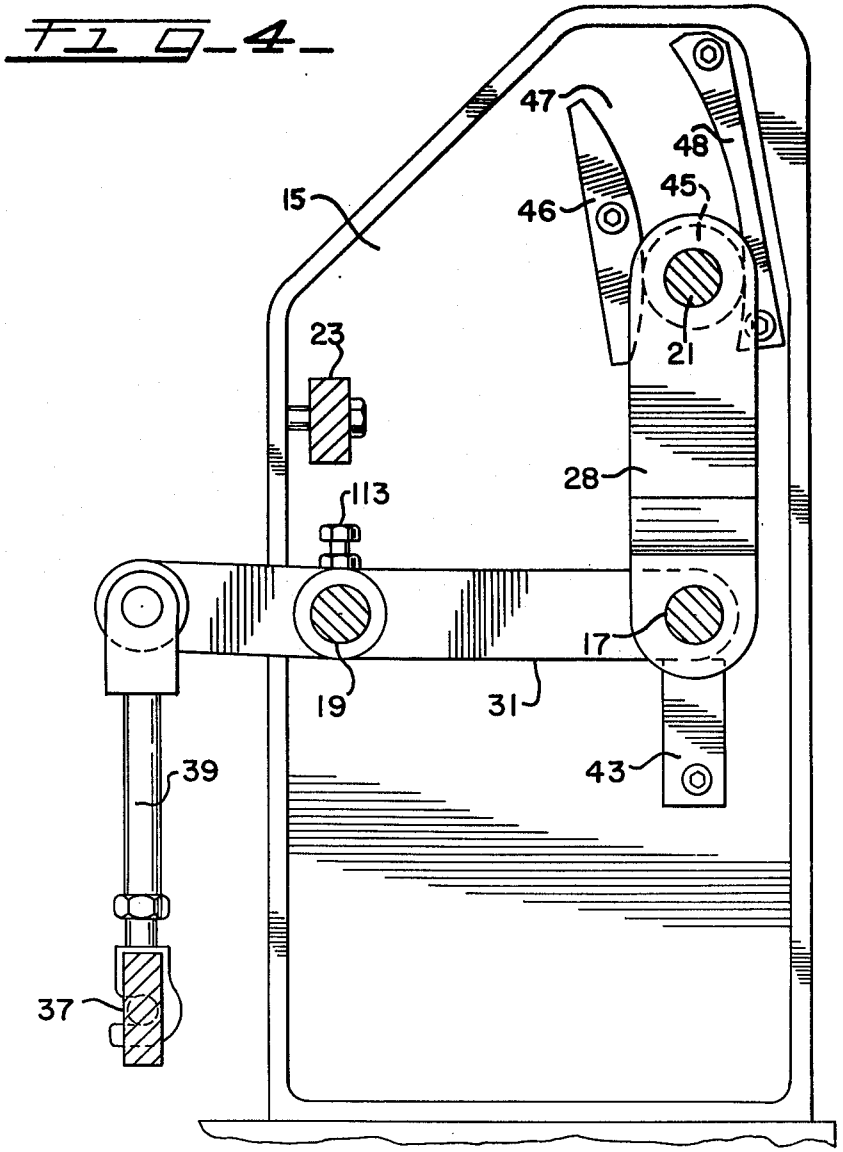
FIG. 4 is a cross-sectional view taken along line 4—4 of FIG. 2, showing the printing position of the screen support means.

As illustrated in FIGS. 2, 3 and 4, the arm 31 extends rearwardly of the shaft 19 and is joined at its rear end to one end of a connecting rod 39. The opposite end of the rod 39 is joined to a lever arm 37 which, as seen in FIG. 2 is pivoted at the opposite end at 42. Between the ends of the arm 37 is provided a cam follower or roller 38, which cooperates with the Swiss cam 41, having the rises 36 and 40. When the cam roller 38 engages the rise at 36, the arm 37 is deflected downward, thereby forcing the arm 31 down at the rear end and elevating the front shaft 17 and the screen and squeegee. Since the vertical links 26 and 28 connect the upper shaft 21, it moves upwardly also. This function will be described in greater detail in connection with the description of the operation of the printer.

Figure 1:
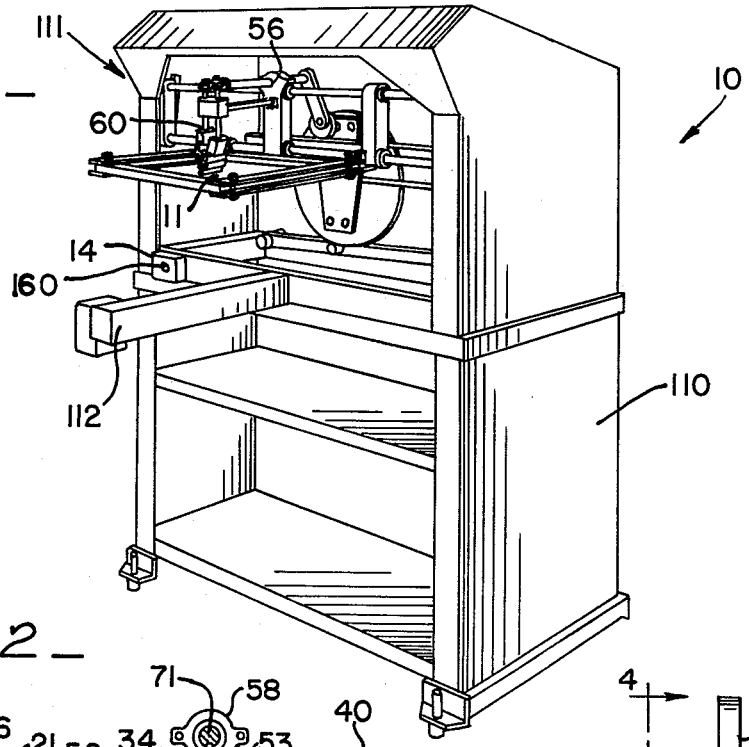
FIG. 1 is a perspective view of the improved screen printing machine of the present invention.
Figure 5:
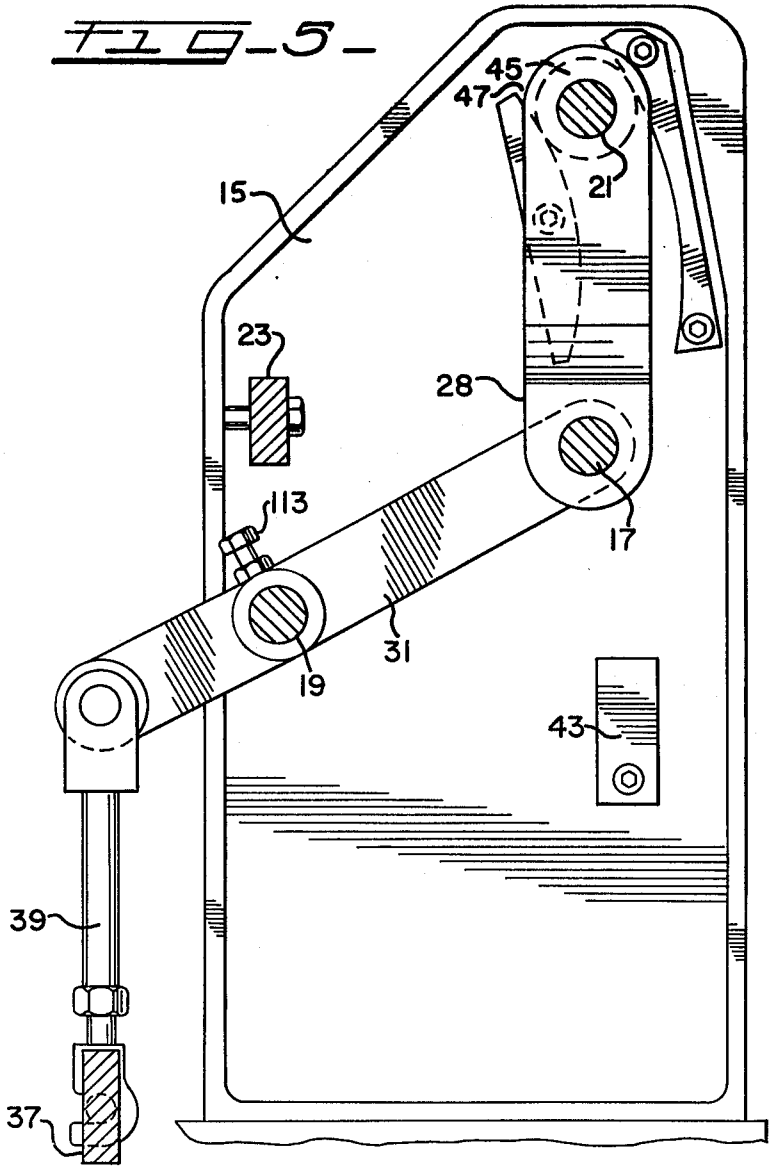
FIG. 5 is a cross-sectional view similar to FIG. 4 of the improved screen printing machine showing the screen in the raised or elevated position.
Figure 8:
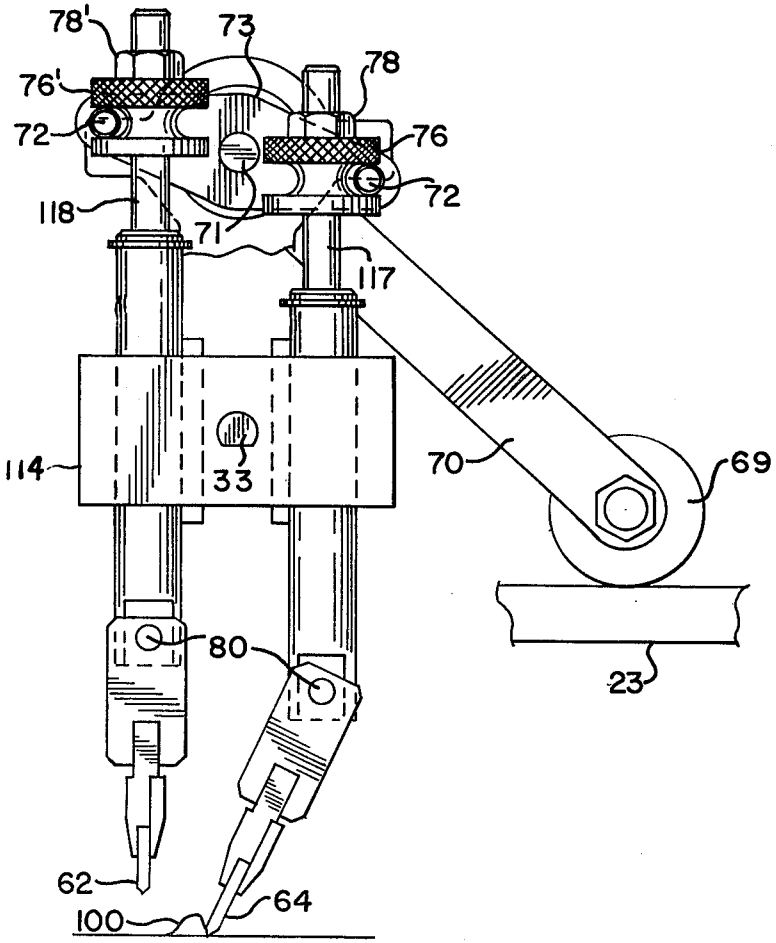
FIG. 8 is a cross-sectional view similar to that of FIG. 7 showing a front view of the squeegee assembly of the screen printing machine of the present invention in the flood position.

The elevation of the front shaft is necessary to permit the printed work to be removed and an unprinted piece registered for printing. In FIGS. 1, 2 and 4, the printing head is shown in the condition it would assume during the print cycle of the machine, with the work and jig or fixture omitted for clarity. The flood or elevated position of the squeegee assembly 60 is shown in FIG. 8, in which, as shown in FIG. 5, the arm 37 is depressed, elevating the front end of the arm 31. The shafts 17 and 21 move upward and the rollers 45 follow their respective paths 47 to maintain the screen horizontal and control the path of movement of the upper shaft. By reason of the arcuate path 47, the shaft 21 maintains the same spatial and vertical relationship to the shaft 17 at all times during the printing and flood cycles. Thus, the screen assembly 11 may be lifted off the material or object being printed in a straight upward displacement, thereby maintaining the screen in a substantially horizontal position at all times in both printing and flood cycles. This constant horizontal position of the screen is important to speed, uniformity of printing, and uniform distribution of ink.

A rigid, rectangular guide bar 23 extends between and is joined to the end supports 13 and 15. The guide bar 23 is disposed directly above the first or rear shaft 19. The function of the guide bar will be described in greater detail below.

Arms 25 and 27 are mounted on shafts 17 and 21 for sliding lateral movement thereon. Attached to the lower ends of the arms 25 and 27 is a screen support bar 35, which bar carries outwardly projecting arms 35' for supporting the frame 91 of the stencil screen. The arms 35' are provided with a suitable clamp of known type for securing and tensioning the screen.

Figure 7:
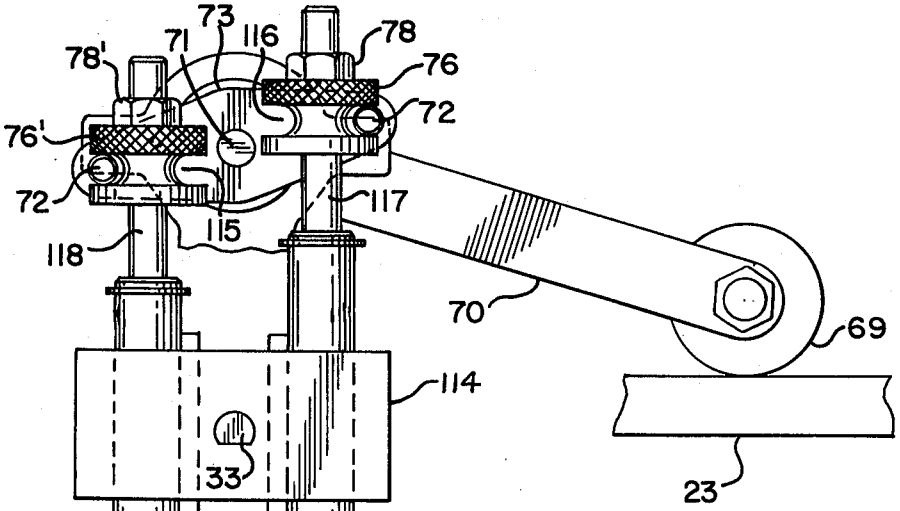
FIG. 7 is a cross-sectional view taken along line 7—7 of FIG. 6 showing a front view of the squeegee assembly in the print position.
Figure 10:
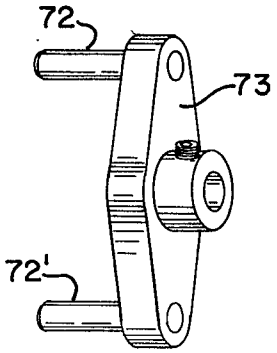

The squeegee assembly is supported by a vertical link 56 (FIGS. 1, 2, 3, 7 and 8), which link is carried by the upper and lower front shafts 21 and 17. The squeegee assembly includes rocker shaft 71, rocker support frame 114, and the support arm 33 joined to the vertical support link 56. The rocker shaft 71 is connected to a rocker arm 73 having pins 72 and 72' at opposite ends. The pins are captivated in arcuate channels or grooves 115 and 116 formed in each of the adjusting nuts 76 and 76', respectively, which are threaded onto the upper end of the rods 117 and 118, which support the squeegee and flood bar, respectively, at their lower ends (see FIG. 7). Squeegee support rod 117 and captivated rocker arm 73 are constantly being urged upwardly in a manner and for a function to be described below.

By adjusting the nuts 76 and 76', the heights of the squeegee 62 and flood bar 64 relative to the screen may be set and adjusted at any time to compensate for wear of the squeegee blade, stretching of the screen, or other factors. Locking nuts 78 and 78' prevent any accidental or gradual upward displacement of the adjusting nuts 76 and 76' beyond that desired.

The rocker arm 73 is easily inserted into the adjusting nuts' central recess 115 and 116 and keyed or otherwise joined to the rod 71 for cooperating pivotal movement. The shaft 71, supporting the rocker arm 73, is oscillated by the raising and lowering of the printing head. An arm 70 is attached to the end of the shaft 71 and has a weighted roller 69 attached to the free end, which roller 69 rides on the top of and remains biased against the guide bar 23 as a result of its weight. Of course, any other means of biasing the roller 69 against the guide bar 23 may be used. In this manner, the arm 70 pivots in a downward direction when the printing head is moved upwardly. This pivotal movement is transmitted through shaft 71 and rocker arm 73 to cause a downward movement of the flood bar shaft 117 and a concurrent upward movement of the squeegee shaft 118. Upon lowering the screen head, the reverse occurs, that is, the arm 70 is pivoted upward, and the flood bar shaft moves upward, while the squeegee's shaft moves downward.

To facilitate a change of screens, squeegee blades, etc., the squeegee assembly is easily swung upwardly and out of the way. The squeegee assembly support rod or bar 33 is pivotally attached, as at 120, to a fork 121 on the vertical link 56. The bottom of the fork 121 has a stop 129, which allows upward movement only of the squeegee holder 114. The shaft 71 may be pulled back, releasing rocker arm 73 from the nuts 76 and 76' to permit the rocker support frame 114 to be lifted. Any other form of quick disconnect may be used on the shaft 71. While the squeegee assembly support 33 is shown pivotal about the pin 120 connecting it to the vertical link 56 with a stop to prevent downward movement, it is to be understood that any suitable arrangement may be used which will enable the squeegee to be elevated relative to the screen. When the shaft 71 is withdrawn, the squeegee assembly is free to be swung upward to allow access to the squeegee blades, flood bar and the screen. With the squeegee assembly elevated, the squeegee 62 and flood bar 64 may be easily removed for replacement or sharpening by withdrawing pins 80. Similarly, the screen may be removed and replaced while the squeegee assembly is elevated.

Figure 9:
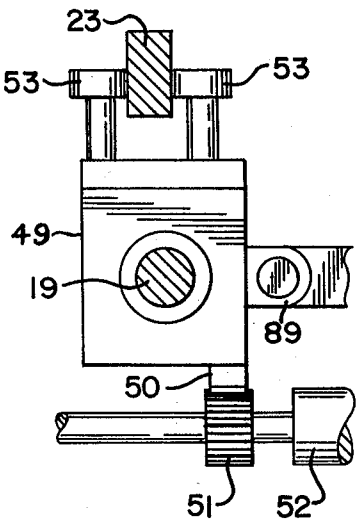
FIG. 9 is a cross-sectional view of the rack and pinion gear assembly of the registering means for the objects of revolution to be printed on by the improved screen printing machine of the present invention; and, FIG. 10 is a perspective view of the rocker arm which elevates and lowers the squeegee and flood bar shafts.
Figure 6:
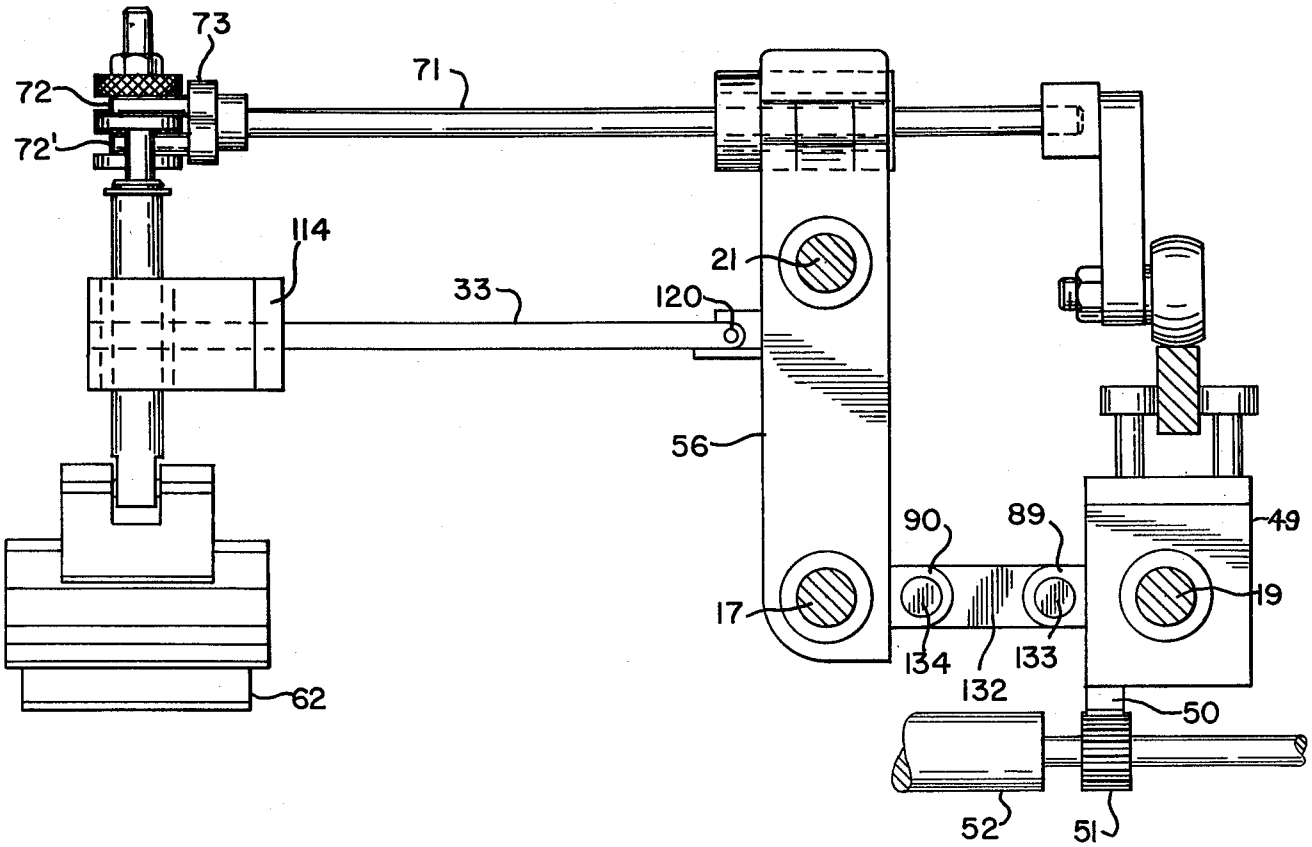
FIG. 6 is a cross-sectional view taken along line 6—6 of FIG. 2 showing the squeegee assembly and support means.

The drive arrangement for the printing press (FIG. 2) includes a variable speed motor, such as a DC motor 12, operating through the reduction gear box 130 of known type. The speed of the press may be varied by turning the knob 160 (FIG. 1), which varies the resistance in the line supplying voltage and current to the motor. The output shaft of the gear box 131 supports a Swiss cam 41, which has been previously mentioned in connection with the lifting and lowering of the screen and squeegee. The Swiss cam 41 is provided with a slot 87 to receive a cam follower 81, which is mounted on a drive carriage 49 supported on the lower rear shaft 19. As the cam rotates, the drive carriage 49 reciprocates on the shaft 19 between limits defined by the slot 87 in the Swiss cam. As seen in FIGS. 6 and 9, the drive carriage is provided with a fork 89, which is joined to a link 132 by a pin 133. The other end of the link 132 may be connected to the fork 90 on the squeegee support 56 by a pin 134 to reciprocate the squeegee if flat work is being done or the link 132 may be joined to a fork 91 (FIG. 3) on the screen to reciprocate the screen when printing curvilinear or tapered work.

As seen in the free-body diagram of FIG. 9, the carriage 49 has guide rollers 53 engaging opposite sides of the guide bar 23 to maintain the proper relation with the shaft 19 and Swiss cam and assure smooth, reciprocating movement. On the underside of the drive carriage 49 is a rack 50, which cooperates with a pinion 51 driving an output shaft 52. The output shaft 52 may support a jig or fixture at its outer end, which receives curved objects to be rotated at the same rate as the linear rate of the screen during printing. An example of such is found in U.S. Pat. No. 3,897,725 issued Aug. 5, 1973.

The operation of the screen printing press 10 of this invention can be best described with reference to its operation during one full printing cycle. If the object to be printed is curvilinear, it is secured by appropriate means to shaft 52 for rotational movement thereabout. The drive means 12 is actuated, which rotates the Swiss cam 41, causing the roller 81 to travel in the radial slot 87, initially in a direction from left to right. The movement of the roller 81 within the vertical slideway 83 causes the carriage 49 to also move from left to right in cooperation with the roller 81 and the movement of the cam 41. Prior to actuation of the drive, the link 132 is joined to the screen to permit the screen to be reciprocated and the squeegee is moved along the shafts 17 and 21 to the proper position and clamped against axial movement by a set screw 93.

After actuation, the movement of the carriage causes a cooperating movement of the screen, thereby bringing the squeegee to bear against a moving screen, distributing ink in the printing cycle. During the movement of the screen, the pinion gear 51 is turned by the movement of the rack 50, rotating the shaft 52 which, in turn, rotates the object to be printed in a precise timed relationship, thereby moving the object surface at the same rate as the screen. The size of the pinion gear, of course, is important in matching the circumferential speeds of various sizes of objects printed with the screen speed. Upon completion of the printing stroke of the squeegee, the roller 38 engages the cam rise 36, depressing the lever 37 and raising shafts 17 and 21, causing the screen and squeegee assembly to be lifted off the object being printed. At this stage in the cycle, the printed object may be removed and an unprinted object placed in position for printing. The raising of the squeegee assembly causes roller 69 and lever arm 70, being biased against control bar 23, to pivot downwardly and thereby rotate rocker arm 73 through the action of the shaft 71 keyed to the rocker arm 73. The rotation of rocker arm 73 raises the squeegee off the screen and lowers the flood bar to the screen surface, flooding the screen on the return stroke. While described as distinct, though related, actions, at the end of the print cycle, the raising of the screen and the lowering of the flood bar are simultaneous movements, all occurring upon the contact of the cam rise 36 with the roller 38.

The cam 41 continues to rotate, causing the carriage 49 to return to its initial position; the corresponding movement of the screen, as it bears against the squeegee assembly and, more particularly, the flood bar, then floods the screen on the return stroke while the screen 11 is in the raised position. Upon contact with the fall 40 of the cam 41, the screen 11 is lowered and the squeegee 62 is biased once again against the screen, to force ink through upon movement of the screen. On lowering the squeegee 62, the flood bar 64 retracts to its raised position.

While the foregoing description treates only the printing of curvilinear surfaces, flat objects or stock may also be printed by the subject invention with a few minor alterations. The pin holding link 132 to the screen frame is detached and connected to squeegee assembly linkage 90 by a pin 134, as shown in FIG. 6. Set screws 92, or other similar means to retain the collar of the vertical screen in a desired position on the shaft 21, are tightened, and set screw 93 on the squeegee support sleeve is loosened, to allow movement of the squeegee assembly on the screen.

Upon making these alterations, the screen printing machine of the present invention is adapted for printing on flat objects. Upon rotation of the cam 41 by drive means 12, the printing cycle begins; the carriage 49 moves in a linear fashion along shaft 19, as does the attached squeegee assembly on shaft 21. In its movement across the screen, the squeegee pushes the pool of ink 100 before it, forcing ink through the interstices of the screen 11, printing the flat object with the desired design or message.

Upon engaging of the cam rise 36 with roller 38, the printing cycle is ended, and the return or flood cycle begins. The shafts 17 and 21 and the screen 11 are lifted up in a straight upward displacement by virtue of the arcuate path followed by the rollers 45 of shafts 17 and 21 in the channels 47. Simultaneously with the upward movement of the screen 11, the squeegee 62 is raised off the screen 11 and the flood bar 64 descends to contact the screen surface 11.

The Swiss cam 41 continues its rotation and the carriage moves in an opposite direction, thereby returning the squeegee assembly to its initial position, the flood bar 64 flooding the screen on the return stroke. Upon reaching its initial position, cam depression 40 is encountered, which brings the screen assembly down, raises the flood bar and lowers the squeegee. All is now ready for another print cycle to begin.

Upon a consideration of the foregoing, it will become obvious to those skilled in the art that various modifications may be made without departing from the invention embodied herein. Therefore, only such limitations should be imposed as are indicated by the spirit and scope of the appended claims.

We claim:

1. A screen printing machine comprising a pair of spaced end supports, a first shaft connecting said end supports for pivotal movement relative to said end supports, arms mounted on opposite ends of said first shaft, a second shaft attached to each of said arms for limited pivotal movement thereabout, a third shaft mounted in parallel relationship to said second shaft and connected to said second shaft by a vertical linkage, said vertical linkage being laterally movable on said second and third shafts, a guide path formed in each of said end supports, each of said guide paths comprising a substantially vertically disposed slot, opposite ends of said third shaft having an extension immovable outside the axis of said third shaft, said extension captivated for movement in said guide path, said guide path restricting the travel of said third shaft for substantially vertical movement of said vertical linkage, means for supporting a screen mounted on said vertical linkage for substantially vertical movement of said screen, means for supporting a squeegee mounted on said second and third shafts for lateral movement relative to said vertical linkage, drive means on said first shaft mounted for lateral movement along said first shaft, means on said drive means for selective alternative connection to one of said means for supporting said squeegee and said means for supporting a screen to permit printing of either curvilinear objects or flat objects, and a guide means for the stabilization of said screen and squeegee in a level position during the operation of said printing machine.

2. The screen printing machine of claim 1 wherein said path is arcuate.

3. The screen printing machine of claim 1 wherein said means for supporting a squeegee include a squeegee assembly having a vertically reciprocal squeegee and flood bar, said squeegee assembly being mounted on said second and third shaft for concurrent movement in the same direction.

4. The screen printing machine of claim 1 wherein said drive means includes a rack to drive a pinion, which pinion rotates the object to be printed.

5. The screen printing machine of claim 1 wherein said screen support means includes a pair of laterally-spaced arms, each of which joins said second and third shaft and mounting means in said arms for mounting a stencil screen frame thereon.

6. The screen printing machine of claim 1 wherein said drive means includes a means for vertically moving said second shaft, thereby lifting said stencil screen and squeegee, said first guide means maintaining said stencil screen in a horizontal condition throughout lifting thereof.

7. A machine for the printing of both curvilinear and flat objects, having two spaced end supports, a squeegee assembly and a screen assembly, said machine including a first shaft pivotally mounted between said end supports, at least two spaced arms connected to said first shaft for following pivotal movement therewith, a second shaft connected to an end of each arm for arcuate movement along a first path of travel, a third shaft connected in parallel to said second shaft by linkages, said third shaft having rollers at opposing ends, arcuate channels formed in said end supports, said rollers being guided by said arcuate channels for controlled movement of said third shaft relative to said second shaft to maintain said linkages substantially vertical, screen support means attached to said second and third shafts for raising and lowering said screen assembly in straight upward displacement, a squeegee support means engaged with said second and third shafts for lateral movement of said squeegee assembly, a guide bar secured between said end supports, a drive carriage on said first shaft for reciprocal sliding movement, said carriage being maintained in a constant attitude by guide means conforming to said guide bar, and drive means for moving said drive carriage in reciprocal fashion along said first shaft.

8. The machine of claim 7 wherein said squeegee assembly is engaged with said second and third shafts for concurrent movement in the same direction.

9. The machine of claim 7 wherein said carriage is selectively connectable to said screen assembly for parallel movement therewith when curvilinear objects are desired to be printed, and to said squeegee assembly for parallel movement therewith when flat objects are desired to be printed.

10. The machine of claim 7 wherein a rack gear is attached to said drive carriage and cooperates with a pinion gear, said pinion gear being rotated upon the reciprocatory sliding movement of said drive carriage for the rotation of curvilinear objects secured thereto when said screen assembly is connected to said drive carriage.

11. The machine of claim 7 wherein said guide means comprises at least two spaced rollers mounted on said carriage for engaging opposite surfaces of said guide bar.

12. A screen printing assembly having a frame, said frame having horizontal shafts, a squeegee assembly, a means for supporting said squeegee assembly, said means for supporting said squeegee assembly being mounted on said frame for vertical movement relative to said shafts and lateral movement parallel to said shafts, a horizontal guide bar fixedly mounted on said frame parallel to said shafts, said squeegee assembly including a flood bar and a squeegee and mounted on said means for supporting said squeegee, each of said flood bar and said squeegee being vertically movable relative to each other and said means for supporting said squeegee assembly, a rod mounted perpendicular to said shafts on said means for supporting said squeegee assembly for rotational movement about a central axis of said rod, a rocker arm with opposing ends disposed perpendicularly to said rod, a first end of said rod being operatively connected to a central portion of said rocker arm, a first end of said rocker arm being connected to said squeegee, a second end of said rocker arm being connected to said flood bar, a second end of said rod opposite said first rod end being biased against said guide bar for reciprocal rotational movement, said squeegee and said flood bar being driven in a reciprocating vertical movement by said reciprocal rotational movement of said rod upon the vertical movement of said squeegee assembly.

* * * * *